US007265504B2

(12) United States Patent
Grant

(10) Patent No.: US 7,265,504 B2
(45) Date of Patent: Sep. 4, 2007

(54) HIGH EFFICIENCY POWER SUPPLY FOR LED LIGHTING APPLICATIONS

(75) Inventor: Matthew Alan Grant, Palo Alto, CA (US)

(73) Assignee: Semtech Corporation, Camarilla, CA (US)

( * ) Notice: Subject to any disclaimer, the term of this patent is extended or adjusted under 35 U.S.C. 154(b) by 0 days.

(21) Appl. No.: 11/450,232

(22) Filed: Jun. 8, 2006

(65) Prior Publication Data

US 2007/0120506 A1 May 31, 2007

Related U.S. Application Data

(60) Provisional application No. 60/741,156, filed on Nov. 30, 2005.

(51) Int. Cl.
*G05F 1/00* (2006.01)

(52) U.S. Cl. ..... 315/308; 315/224

(58) Field of Classification Search ..... 315/224–226, 315/291, 299, 300, 301, 307–308, 312; 323/274, 323/275, 282, 284, 285
See application file for complete search history.

(56) References Cited

U.S. PATENT DOCUMENTS 5,877,596 A * 3/1999 Allison ..... 315/308
6,836,081 B2 * 12/2004 Swanson et al. ..... 315/307
7,116,086 B2 * 10/2006 Burgyan et al. ..... 323/271
7,141,940 B2 * 11/2006 Ortiz ..... 315/291
7,180,280 B2 * 2/2007 Currell ..... 323/285
2003/0001516 A1 * 1/2003 Newman et al. ..... 315/224

* cited by examiner

*Primary Examiner*—Trinh Dinh
*Assistant Examiner*—Tung Le
(74) *Attorney, Agent, or Firm*—O'Melveny & Myers LLP

(57) ABSTRACT

A power supply for plural loads coupled in parallel comprises a voltage regulator, a plurality of current regulators, and an error control circuit. The voltage regulator provides a common output voltage to the plural loads. The voltage regulator comprises a sensor circuit providing a voltage sense signal corresponding to the output voltage, which provides feedback to regulate the output voltage at a selected level. The plurality of current regulators are coupled to respective ones of the plural loads. Each of the plurality of current regulators regulates current drawn by respective ones of the plural loads to within a desired regulation range. The plurality of current regulators each further provide a respective error signal corresponding to an ability to remain within the desired regulation range. The error control circuit is operatively coupled to the voltage regulator and to the plurality of current regulators. The error control circuit receives the error signals from the plurality of current regulators and provides a common error signal to the voltage regulator. The voltage regulator thereby changes the selected level of the output voltage in response to the common error signal. Accordingly, the selected level of the output voltage remains at a minimum voltage necessary to keep the plural loads in the desired regulation range.

20 Claims, 3 Drawing Sheets

HIGH EFFICIENCY POWER SUPPLY FOR LED LIGHTING APPLICATIONS

RELATED APPLICATION DATA

This application claims priority pursuant to 35 U.S.C. § 119(e) to provisional patent application Ser. No. 60/741,156, filed Nov. 30, 2005, the subject matter of which is incorporated by reference herein in its entirety.

BACKGROUND OF THE INVENTION

1. Field of the Invention

The present invention relates to driver circuits for light emitting diodes (LEDs).

2. Description of Related Art

LEDs are increasingly used in lighting applications, such as to provide back lighting for a liquid crystal display in which the LEDs are generally connected together in series in long strands. In such applications, it is desirable that the LEDs provide generally uniform illumination. Accordingly, it is necessary to closely regulate the current applied to the LED strands in order to maintain uniform illumination and provide efficient operation.

There are two methods generally used in the art to achieve constant current regulation of loads such as series-connected LEDs. The first method is to provide regulated output voltage and directly regulated load current. This method is often used in devices in which the control of the current must be very accurate and resistant to noise. A charge pump or boost converter generates a fixed supply voltage, and the LED strands are current-regulated from this voltage using respective linear current regulators. A drawback of this method is that the output voltage must be set conservatively high to account for device and temperature variation, resulting in wasted power and excess heat generated in the system. Where there are multiple strands with differing numbers of LEDs, the fixed output voltage must be set to the highest voltage requirement, thereby wasting a significant amount of power, particularly with respect to lower voltage strands having fewer series-connected LEDs.

The second method is to provide regulated current output and indirectly regulated output voltage. In this method, a voltage-feedback boost converter or charge pump provides an output voltage to the LED strands. The LED strands (i.e., load) are placed in series with a ballast resistor. The voltage across the ballast resistor is regulated by the boost converter or charge pump, thereby regulating the current through the load. This method has an advantage of seeking the minimum output voltage necessary to achieve the desired current. Its drawbacks stem from the fact that only one load current is directly regulated. Multiple strands each require separate ballast resistors to make up for the voltage mismatch in the LED strand loads. This results in less accurate control of current in the other LED strands. The LED strands also cannot be controlled independently or shut off when ballasted by resistors. Finally, in the case of differing numbers of LEDs in each strands, the strand with the highest voltage mismatch must drop the voltage mismatch across the ballast resistors, which wastes power.

In another type of implementation, multiple strands are current-regulated using linear current regulators, and an outer voltage regulator drives the output until the strand with the highest voltage drop load reaches a fixed reference voltage at the cathode of the LED strand. The disadvantage of this method is that the fixed reference voltage must be set conservatively high to account for the variation in the current regulator's voltage requirement due to process, temperature, and load variation.

By way of example, a conventional LED driver circuit may drive a first strand containing four white LEDs at 20 mA, for a total output voltage $V_{OUT}$ of 14V (i.e., 4×3.5V). The LED driver circuit may also support the occasional load of a second strand containing six white LEDs driven with 20 mA for a total output voltage $V_{OUT}$ of 21V. Since both loads may be driven at the same time, the minimum output voltage for a conventional resistor-ballasted, or fixed-output device must be greater than 21V to support either or both loads, taking into account ordinary lot-to-lot and temperature variation of the LEDs. Often, two inductive boost converters would have to be used, with each one driving a separate strand to its optimum efficiency point. This is not desirable, however, since the use of two converters is prohibitively expensive. As a result, most manufacturers resort to ballasting the first strand to above 21V using ballast resistors, causing constant loss of power dissipated in the ballast resistor that is not converted to light, reducing the overall efficiency of the system.

Accordingly, it is desirable to provide current regulation of LED strands in order to maintain uniform illumination and provide efficient operation, while overcoming the various drawbacks of the prior art.

SUMMARY OF THE INVENTION

The invention overcomes the drawbacks of the prior art by providing a power supply that provides directly regulated multiple load currents with an indirectly regulated single output voltage. Linear current regulators independently regulate the load currents, and the output voltage of the voltage regulator or converter is adjusted using feedback information from all current regulators. This allows very accurate current regulation under changing output voltage conditions, as well as the ability to switch between several operating conditions as different loads are energized or de-energized. Moreover, the voltage regulator or converter does not need a pre-determined output voltage setpoint and always seeks the lowest possible output voltage that will keep all current regulators in an active mode, thereby automatically seeking the highest efficiency operating point at any given condition.

In an embodiment of the invention, a power supply for plural loads coupled in parallel comprises a voltage regulator, a plurality of current regulators, and an error control circuit. The voltage regulator provides a common output voltage to the plural loads. The voltage regulator comprises a sensor circuit providing a voltage sense signal corresponding to the output voltage, which provides feedback to regulate the output voltage at a selected level. The plurality of current regulators are coupled to respective ones of the plural loads. Each of the plurality of current regulators regulates current drawn by respective ones of the plural loads to within a desired regulation range. The plurality of current regulators each further provide a respective error signal corresponding to an ability to remain within the desired regulation range. The error control circuit is operatively coupled to the voltage regulator and to the plurality of current regulators. The error control circuit receives the error signals from the plurality of current regulators and provides a common error signal to the voltage regulator. The voltage regulator thereby changes the selected level of the output voltage in response to the common error signal. Accordingly, the selected level of the output voltage remains at a minimum voltage necessary to keep the plural loads in the desired regulation range.

More particularly, the plurality of current regulators each comprises an operational amplifier and a bipolar device. Each bipolar device is operatively coupled to a respective one of the plural loads. Each operational amplifier drives the corresponding bipolar device responsive to a feedback signal corresponding to current through the bipolar device. The error signals of the plural current regulators each reflects a saturation condition of the respective bipolar device. The plural current regulators may each further comprise a saturation detector providing the respective error signals.

In another embodiment of the invention, a method for supplying power to plural loads coupled in parallel comprises the steps of: (a) providing a common output voltage to the plural loads, the common output voltage being regulated to a selected level responsive to a voltage feedback signal and a common error signal; (b) regulating current drawn by each individual one of the plural loads to within a desired regulation range; (c) providing a respective error signal corresponding to an ability of each load to remain within the desired regulation range, and (d) combining the error signals to provide the common error signal, the selected level of the output voltage thereby changing in response to the common error signal such that the selected level of the output voltage is a minimum voltage to keep each of the plural loads in their respective desired regulation range.

A more complete understanding of the high efficiency power supply for LED lighting applications will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The invention provides a power supply for efficiently driving plural LED strands in which multiple current regulators feed back control information to a single voltage regulator or converter, allowing the power supply to adjust the output voltage to the optimum setpoint for varying load conditions.

More particularly, the power supply provides directly regulated multiple load currents with an indirectly regulated single output voltage. Linear current regulators independently regulate the load currents, and the output voltage of the voltage regulator or converter is adjusted using feedback information from all current regulators. This allows very accurate current regulation under changing output voltage conditions, as well as the ability to switch between several operating conditions as different loads are energized or de-energized. Moreover, the voltage regulator or converter does not need a pre-determined output voltage setpoint and always seeks the lowest possible output voltage that will keep all current regulators in an active mode, thereby automatically seeking the highest efficiency operating point at any given condition.

Figure 1:
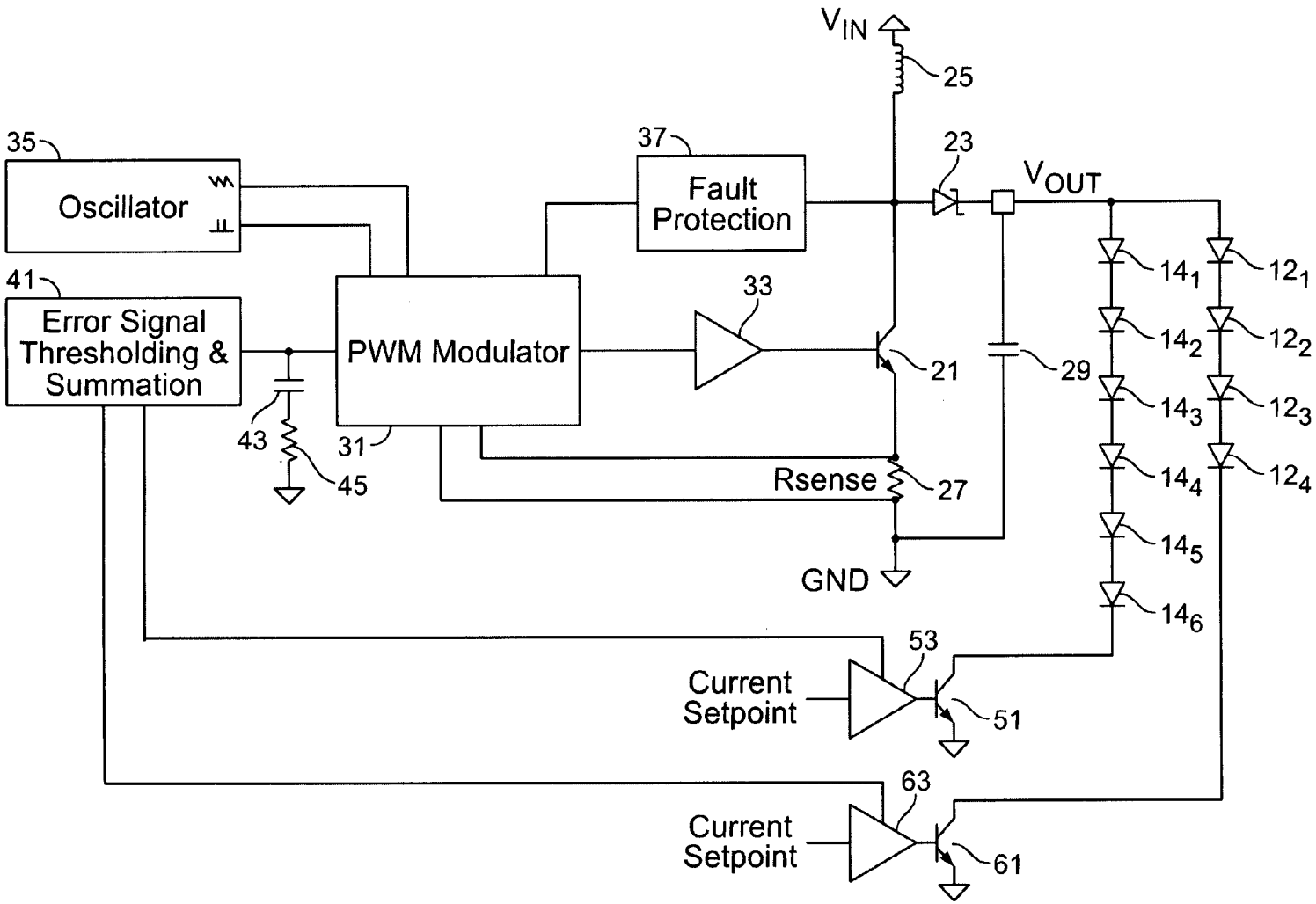
FIG. 1 is a schematic block diagram of an LED strand power control circuit in accordance with an embodiment of the invention.

Referring to FIG. 1, a circuit diagram of an exemplary LED driver circuit is illustrated according to an embodiment of the invention. The LED driver circuit may be implemented on a single integrated circuit or chip. As depicted in FIG. 1, the LED driver circuit is driving two parallel LED strands, including a first strand comprising four serial-connected LEDs $\mathbf{12}_1$-$\mathbf{12}_4$ and a second strand comprising six serial-connected LEDs $\mathbf{14}_1$-$\mathbf{14}_6$. It should be understood that this depiction of LED strands is exemplary, and that different numbers of LED strands and different numbers of LEDs within each strand may be driven by the LED driver circuit in like manner.

The LED driver circuit provides a common output voltage ($V_{OUT}$) to the parallel LED strands. The exemplary LED driver circuit shown in FIG. 1 has an inductive boost converter topology, although it should be appreciated that the present regulation method could utilize any known voltage regulator topology using an error amplifier to provide the output voltage setpoint, such as a low dropout regulator (LDO), buck, boost, buck-boost, flyback, forward, and charge pump regulator. This regulator could be developed in CMOS. or bipolar technology. In an exemplary LED driver circuit using bipolar technology, an NPN transistor 21 provides a switch to successively transfer current to an output diode 23. An input inductor 25 is coupled to an input voltage ($V_{IN}$) and to the collector terminal of the transistor 21. The emitter terminal of the transistor 21 is coupled to ground through a current sense resistor 27. The base terminal of the transistor 21 is driven at a desired duty cycle by a pulse width modulator (PWM) circuit 31 through a suitable driver 33. An output capacitor 29 is coupled between the cathode of the output diode 23 and ground. By closing the transistor switch 21, current builds up in the input inductor 25. When the transistor switch 21 is opened, the current is forced through the diode 23 to the output capacitor 29. Multiple switching cycles build up the voltage in the output capacitor 29 due to transfer of energy from the input inductor current. This results in an output voltage $V_{OUT}$ that is higher than the input voltage $V_{IN}$. The output diode 23 may ideally be provided by a fast Schottky diode that provides low voltage drop, yielding low power dissipation and higher efficiency.

The PWM circuit 31 receives various inputs to regulate operation of the LED driver circuit. The voltage across the sense resistor 27 corresponds to the current passing through the transistor switch 21, and may be used as a feedback signal to the PWM circuit 31 to control the duty cycle in order to indirectly regulate the output voltage $V_{OUT}$. The PWM circuit 31 may further receive a clock signal from an oscillator 35. A fault protection circuit 37 coupled to the PWM circuit 31 and to the output diode 23 is adapted to detect a fault condition in which the voltage present at the anode of the diode rises to a dangerous level, such as due to an open circuit condition on one of the LED strands, and thereby shut off operation of the PWM circuit 31.

In a conventional inductive boost converter, or other type of voltage regulator, it is known to measure an error signal that corresponds to deviations of the output current from a desired setpoint, and to apply the error signal in a feedback loop to regulate the duty cycle provided by the PWM circuit. More particularly, the integral of the error signal defines the instantaneous setpoint of the converter, which along with the power control circuitry and error amplifier continually drives the error toward zero to achieve output regulation under changing load conditions. A single error signal proportional to the difference between a current and desired operating point has been used as the integrand in this feedback loop. For example, an output terminal of the converter may be regulated to a fixed output voltage by the use of a resistor divider, or it can be used to sense the voltage across a resistive ballast to indirectly control current through a load. While this method is very suitable for use with a single unknown load or multiple known loads, it does not have the ability to efficiently regulate multiple unknown or changing loads, as only a single error signal does not provide enough information to determine the optimum output voltage for a given condition.

Furthermore, multiple error signals based on several voltage setpoints, such as the conventional type of converter that would regulate several ballast resistors to a known voltage, has the disadvantage that voltage differences between the loads must be dropped across the ballast resistors if multiple loads must be driven at one time. This creates the disadvantage that the converter cannot adapt to changing conditions and the output voltage must be fixed for the worst case when multiple loads are driven, dropping voltage across the ballast resistors and causing a power loss.

In contrast, the invention overcomes these drawbacks by providing a voltage converter that uses multiple current regulators, each providing feedback about its ability to regulate the required current, and sums these error signals to determine the instantaneous converter setpoint. For the case of multiple loads, the present converter operates at the proper operating point for each load when only that load is driven, but has the ability to change operating points as the other loads are enabled or disabled. This forces the converter to provide the minimum output voltage to keep multiple loads in regulation, while also forcing the converter to provide the minimum output voltage when only a single load is driven; This adjustment between multiple operating points guarantees that the converter is operating at the highest efficiency point for any given condition, with the additional advantage that the load current is always regulated to the proper setpoint regardless of the output voltage. This allows accurate control of load current with multiple setpoints using a single voltage regulator. Thus, in the invention, the voltage converter needs no pre-set regulation point, and is therefore a truly adaptive method able to achieve higher efficiency than previous methods.

Referring again to FIG. 1, the LED driver circuit includes a separate current regulator circuit coupled to each respective strand of LEDs. Each separate current regulator circuit provides current regulation to a respective current setpoint, and provides a respective error signal to a common thresholding and summation circuit 41. The combined error signal is integrated by the series coupled capacitor 43 and resistor 45, and the integrated error signal provided to the PWM circuit 31 for regulation of the LED driver circuit. Further details of the current regulator circuits are provided below with respect to FIGS. 2 and 3.

In the exemplary LED driver circuit of the present invention, the current regulators cause the output voltage $V_{OUT}$ to be adjusted to 14V when only the four LED strand is driven, raising the output voltage to 21V when the six LED strand is driven or when both strands are driven. No additional ballasting is needed to provide for lot-to-lot or temperature variation, and the output voltage $V_{OUT}$ need not be fixed to the highest output case, saving a great deal of power in the nominal condition. Furthermore, the load current in the four LED strand is accurately regulated to 20 mA even under the condition of higher output voltage, preventing undesirable modulation of brightness that can occur with resistor-ballasted devices. Both or multiple LED strands could be turned on or off independently while the output of the voltage converter is continually adjusted to the highest efficiency operating point at any given moment. When the six LED strand is turned off, the output voltage $V_{OUT}$ is automatically reduced to meet the smaller strand's voltage requirement, driving the system to the minimum required output voltage $V_{OUT}$ for highest efficiency operation.

Figure 2:
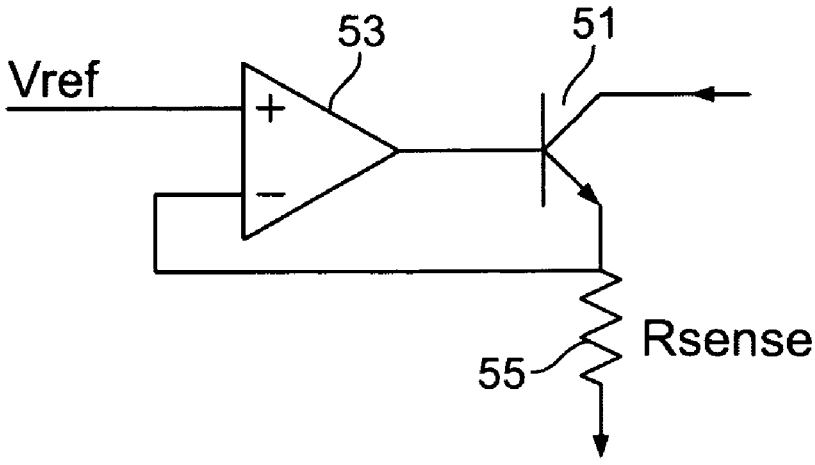
FIG. 2 is a schematic diagram of a current regulator circuit for use in the LED strand power control circuit.

Referring to FIG. 2, a first embodiment of a current regulator circuit is shown in greater detail. Although the current regulator circuit could be formed using either bipolar or CMOS devices, the present description provides a bipolar implementation. As shown in FIG. 2, a bipolar current regulator includes an operational amplifier 53 and an NPN transistor 51 with a small, current sensing resistor 55 used as the feedback device for the current regulator. The output terminal of the operational amplifier 53 is coupled to the base terminal of the transistor 51. A feedback loop is provided between the inverting terminal of the operational amplifier 53 and the emitter of the transistor 51, which is coupled to ground through the current sensing resistor 55. The collector terminal of the transistor 51 is coupled to the LED strand, as shown in FIG. 1. A reference voltage applied to the non-inverting terminal of the operational amplifier 53 causes the operational amplifier to drive the transistor 51 until the voltage across the sensing resistor 55 matches the reference voltage $V_{REF}$, thereby ensuring regulation of the output current through the LED strand as long as the voltage at the collector of the transistor 51 is large enough to support regulation.

The transistor 51 needs some finite collector-to-emitter voltage to support operation in the linear range, due to junction characteristics and the effective collector resistance of the transistor. If the voltage at the collector of the transistor 51 is not large enough to support regulation of the requested current, the operational amplifier 53 will overdrive the base of the transistor 51 as long as regulation is not achieved. This will cause saturation of the transistor 51, a condition in which the base-collector voltage is no longer reverse biased and current flows parasitically from the base to the collector. Since the entrance of saturation determines the lowest possible collector voltage that allows the operational amplifier to achieve current regulation, the saturation characteristic of the transistor 51 is a good indicator of the lowest physical voltage that will support regulation, and this characteristic is translated into the current regulator error signal that is communicated back to the PWM circuit 31, as described above with respect to FIG. 1.

Since a strand of LEDs can be considered an almost constant voltage load, the thresholding and summation circuit 41 receives a saturation signal from the transistor 51 of the current regulator until the output voltage $V_{OUT}$ rises to the minimum voltage necessary to support current regulation. At this time, the transistor 51 of the current regulator leaves saturation and the LED driver circuit no longer needs to increase the output voltage $V_{OUT}$. In this manner, the LED driver circuit can regulate the output voltage $V_{OUT}$ to the minimum voltage required to provide the necessary current to an unknown load.

Figure 3:
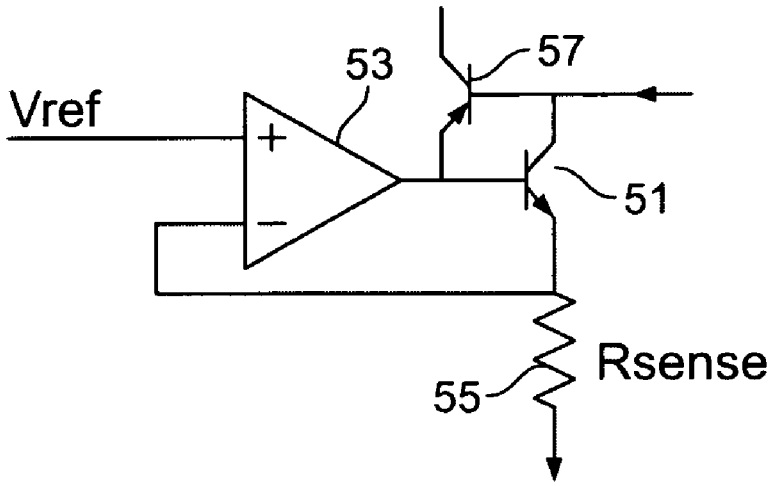
FIG. 3 is a schematic diagram of the current regulator circuit including a saturation detector circuit.

A device that can be used to provide the saturation error signal is generally referred to in the art as a "sat catcher" or "sat detector". Referring to FIG. 3, a sat detector circuit may be provided by a PNP transistor 57 having an emitter terminal coupled to the output terminal of the operational amplifier 53, a base terminal to the collector terminal of the NPN transistor 51, and a collector terminal providing the saturation output signal. The PNP transistor 57 is configured to activate when the NPN transistor 51 collector voltage falls below the NPN base voltage by an amount sufficient to forward-bias the PNP transistor 57. In the planar process, the lateral PNP emitter-base junction may be made from the same diffusions as the NPN base-collector junction. As a result, tracking and matching of these junctions would be excellent, allowing accurate detection of the degree of saturation of the NPN transistor 51.

Figure 4:
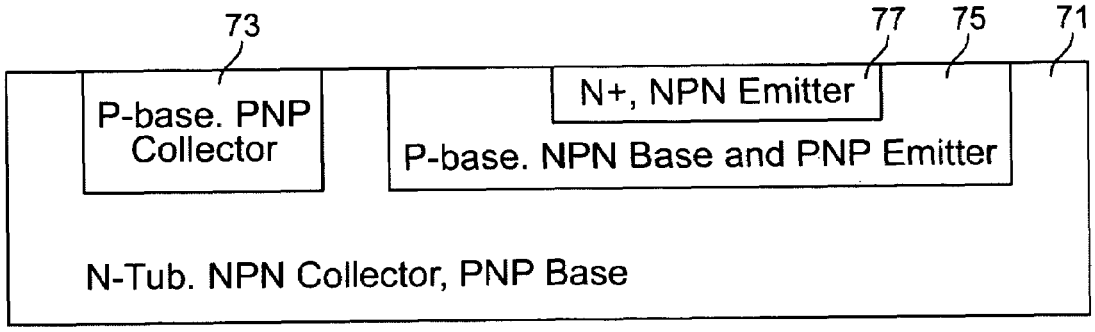
FIG. 4 is a sectional view of a semiconductor device providing the current regulator circuit of FIG. 3.

As shown in FIG. 4, an improved configuration can be provided by merging the NPN and PNP devices by adding regions of P-base (PNP collector) 73 near the regions of NPN base 75 in the same semiconductor tub 71 as the NPN output device. Electrically, this is similar to the configuration of FIG. 3 using a discrete PNP device. However, the device of FIG. 4 is more compact and the error current collected by the new P-base region is the actual saturation current leaving the base of the NPN device. This would allow extremely accurate detection of saturation in a compact device.

In the event that the NPN transistor 51 saturates, current will flow from the NPN base regions 75 and will be collected by the PNP collector regions 73, thereby providing a raw error signal or current that can be used to detect the degree of saturation in the NPN output device. For the case of multiple current regulators driving loads of different voltage drop, only the current regulator with the largest voltage drop load would provide an error signal through saturation. For the case of multiple current regulators with loads of identical voltage drop, the error signals would be summed equally to determine the most efficient operating point for the LED driver regulation loop.

In the event that the applied error signal is a current, this error current could be manipulated through operations such as mirroring, gain, additive or subtractive summation, and the like, in order to provide an error signal that can be used as the integrand in the feedback loop of the LED driver voltage converter. Furthermore, the raw error currents from several current regulators can be summed or differenced at any point during the manipulation operations to give an overall error signal representative of all regulators' degree of saturation. In this manner, the gain of the overall feedback loop of the converter can be set to be dependent or independent of the number of current regulators that are contributing. The error signals can also be used to tailor the gain and profile of the AC response of the overall regulation loop in order to provide gain independence with regard to such factors as temperature and process variation, output voltage and output load.

Moreover, an error signal need not be taken from the output transistor, and can instead be taken from an internal node of the operational amplifier used in the current regulator (as shown in FIG. 1). For the case of a CMOS implementation in which operational amplifiers drive the gates of NMOS transistors, it should be appreciated that the saturation characteristic of NPN devices, and the corresponding PNP sat detector structure, would not apply. Instead, since a CMOS transistor is voltage-driven and does not sink DC current from the operational amplifier, it is possible to detect a loss of regulation at several points inside the operational amplifier structure to generate a suitable error signal to be used as the integrand in the regulation loop of the LED driver voltage regulator.

While the bipolar approach of FIGS. 2 and 3 is not limited to the use of a sat detector to detect the ability of the current regulator to achieve regulation, the CMOS approach is not limited to the few examples given here. In general, many known techniques could be used to detect the ability or lack of ability to regulate, and such a signal could then be used as the error term in the regulation loop.

One potential embodiment could rely on the fact that in regulation, the two terminals of the current regulator operational amplifier would be driven toward equality. At this point, the operational amplifier can be considered balanced and in regulation. For the case of a PMOS input operational amplifier, a balanced condition is detected by equal currents in the positive and negative side of a differential pair. Consequently, an unbalanced condition is detected when greatly unequal currents are found in the same differential pair. Detecting the level of equality can be achieved with simple current mirrors of the differential pair output, a duplicate differential pair, a duplicate output stage, or many other techniques generally known to those skilled in the art.

Figure 5:
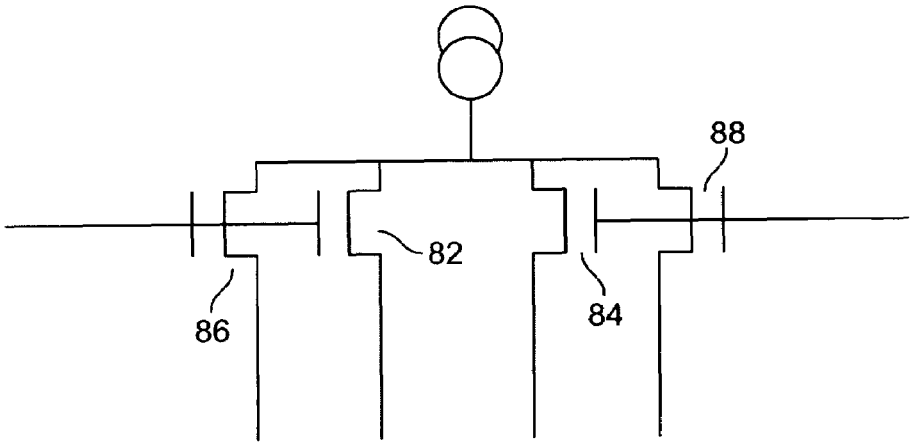
FIG. 5 is a schematic diagram of an operational amplifier differential pair with regulation sense.

FIG. 5 illustrates an example of an operational amplifier differential pair with regulation sense. The inner pair of devices 82, 84 could be used as the differential pair of the operational amplifier, and the outer pair 86, 88 could be used as the differential pair sensing the amplifier's ability to regulate. While this is only one of many techniques that could be used, it demonstrates a structure that could be used to implement the regulation method disclosed herein. The differential currents of the structure of FIG. 5 could also be manipulated through operations such as mirroring, gain, additive or subtractive summation, and the like, in order to provide a suitable error signal that can be used as the integrand in the feedback loop of a voltage regulator or converter.

Having thus described a preferred embodiment of a high efficiency power supply for LED lighting applications, it should be apparent to those skilled in the art that certain advantages of the described method and apparatus have been achieved. It should also be appreciated that various modifications, adaptations, and alternative embodiments thereof may be made within the scope and spirit of the present invention. The invention is defined solely by the following claims.

What is claimed is:

1. A power supply for plural loads coupled in parallel, comprising:

a voltage regulator providing a common output voltage to the plural loads, the voltage regulator comprising a sensor circuit providing a voltage sense signal corresponding to the output voltage, the voltage sense signal providing feedback to regulate the output voltage at a selected level;

a plurality of current regulators coupled to respective ones of the plural loads, each of the plurality of current regulators regulating current drawn by respective ones of the plural loads to within a desired regulation range, the plurality of current regulators each further providing a respective error signal corresponding to an ability to remain within the desired regulation range, and an error control circuit operatively coupled to the voltage regulator and to the plurality of current regulators, the error control circuit receiving the error signals from the plurality of current regulators and providing a common error signal to the voltage regulator, the voltage regulator thereby changing the selected level of the output voltage in response to the common error signal;

wherein, the selected level of the output voltage is a minimum voltage to keep the plural loads in the desired regulation range.

2. The power supply of claim 1, wherein the plural loads each further comprise a string of light emitting diodes (LEDs).

3. The power supply of claim 1, wherein the common error signal provided by the error control circuit comprises a sum of the error signals from the plurality of current regulators.

4. The power supply of claim 1, where in the error control circuit further comprises an integrator circuit providing an integration of the common error signal.

5. The power supply of claim 1, wherein the voltage regulator comprises an inductive boost converter topology.

6. The power supply of claim 1, wherein the voltage regulator further comprises a power switch operatively coupled to an input voltage through an inductor, a diode having an anode coupled to the power switch and a cathode coupled to ground through an output capacitor, the output voltage being provided across the output capacitor, the power switch being driven by a pulse width modulator providing a duty cycle in accordance with the voltage sense signal and the common error signal.

7. The power supply of claim 6, wherein the power switch comprises a bipolar device.

8. The power supply of claim 6, further comprising a fault detector coupled to the power switch and the pulse width modulator, the fault detector adapted to detect a fault condition of the power supply and thereby shut off operation of the pulse width modulator.

9. The power supply of claim 6, wherein the sensor circuit comprises a sense resistor operatively coupled to the power switch.

10. The power supply of claim 1, wherein the sensor circuit comprises a sense resistor.

11. The power supply of claim 1, wherein the voltage regulator has a topology selected from the group including inductive boost converter, low dropout regulator, buck converter, boost converter, buck-boost converter, flyback converter, forward converter, and charge pump regulator.

12. The power supply of claim 1, wherein each one of the plurality of current regulators comprises an operational amplifier and a bipolar device, each bipolar device is operatively coupled to a respective one of the plural loads, each operational amplifier driving the corresponding bipolar device responsive to a feedback signal corresponding to current through the bipolar device.

13. The power supply of claim 12, wherein the error signals of the plural current regulators reflects a saturation condition of the bipolar device.

14. The power supply of claim 1, wherein the plural current regulators each further comprise a saturation detector providing the respective error signals.

15. The power supply of claim 1, wherein the sense resistor is indirectly coupled to the output voltage.

16. A method for supplying power to plural loads coupled in parallel, comprising:

providing a common output voltage to the plural loads, the common output voltage being regulated to a selected level responsive to a voltage feedback signal and a common error signal;

regulating current drawn by each individual one of the plural loads to within a desired regulation range;

providing a respective error signal corresponding to an ability of each load to remain within the desired regulation range, and combining the error signals to provide the common error signal, the selected level of the output voltage thereby changing in response to the common error signal such that the selected level of the output voltage is a minimum voltage to keep each of the plural loads in their respective desired regulation range.

17. The method for supply power of claim 16, wherein the plural loads each further comprise a string of light emitting diodes (LEDs).

18. The method for supplying power of claim 16, wherein the combining step further comprises integrating a sum of the error signals.

19. The method for supplying power of claim 16, further comprising detecting a fault condition in which the common output voltage exceeds a predetermined level.

20. The method for supplying power of claim 16, wherein the regulating step further comprises detecting a saturation condition.

* * * * *